US009724699B2

(12) United States Patent
Fukuhiro

(10) Patent No.: US 9,724,699 B2
(45) Date of Patent: Aug. 8, 2017

(54) CRUSHER

(71) Applicant: KORITSU INDUSTRIES CO., LTD., Okayama (JP)

(72) Inventor: Yasutaka Fukuhiro, Okayama (JP)

(73) Assignee: KORITSU INDUSTRIES CO., LTD., Okayama (JP)

( * ) Notice: Subject to any disclaimer, the term of this patent is extended or adjusted under 35 U.S.C. 154(b) by 278 days.

(21) Appl. No.: 14/429,418

(22) PCT Filed: May 30, 2014

(86) PCT No.: PCT/JP2014/064387
§ 371 (c)(1),
(2) Date: Mar. 19, 2015

(87) PCT Pub. No.: WO2015/181943
PCT Pub. Date: Dec. 3, 2015

(65) Prior Publication Data

US 2016/0256872 A1 Sep. 8, 2016

(51) Int. Cl.
*B02C 13/04* (2006.01)
*B02C 23/16* (2006.01)

(52) U.S. Cl.
CPC ..... *B02C 13/04* (2013.01); *B02C 23/16* (2013.01); *B02C 2023/165* (2013.01)

(58) Field of Classification Search
CPC .... B02C 13/04; B02C 23/16; B02C 2023/165
USPC ..... 241/194, 195
See application file for complete search history.

(56) References Cited

U.S. PATENT DOCUMENTS 1,920,947 A * 8/1933 Armstrong ..... B02C 13/28 241/194
5,683,044 A * 11/1997 Gueldenpfennig ..... B02C 13/04 241/14

FOREIGN PATENT DOCUMENTS

| | | |
|---|---|---|
| JP | 33-541 | 1/1958 |
| JP | 62-174638 | 11/1987 |
| JP | 8-117634 | 5/1996 |

OTHER PUBLICATIONS

English translation of International Search Report issued Sep. 2, 2014 in International (PCT) Application No. PCT/JP2014/064387.
English translation of International Preliminary Report on Patentability and Written Opinion of the International Searching Authority issued Dec. 6, 2016 in corresponding International (PCT) Application No. PCT/JP2014/064387.

* cited by examiner

*Primary Examiner* — Mark Rosenbaum
(74) *Attorney, Agent, or Firm* — Wenderoth, Lind & Ponack, L.L.P.

(57) ABSTRACT

An erecting angle regulating part 50 is provided to regulate an erecting direction upper limit angle θ1 of a crushing hammer 13 at a predetermined angle (e.g., approximately 50°) during driving of a rotary drive shaft 17.

9 Claims, 7 Drawing Sheets

(a)

(b)

CRUSHER

TECHNICAL FIELD

The present invention relates to a crusher, to which a plurality of crushing hammers are swingably mounted in a circumferential direction of a rotary drive shaft, and particularly to a crusher suitable for crushing a hard disk, a solid state drive (SSD) , an electronic circuit board, a mobile phone, a flash memory, a CD, a DVD, an FD, an MO, a cash card and the like.

BACKGROUND ART

A crusher having swingable crushing hammers (swinging type crushing hammers) is known, for example, as in Patent Document 1 (JP 8-117634 A). In the crusher, as illustrated in FIGS. 7(*a*) and 7(*b*), a plurality of crushing hammers 120 are mounted to a rotating disk 110 fixed to a horizontal rotary drive shaft 100. Each of the crushing hammers 120 is swingable about a support shaft 130 fixed to the rotating disk 110. When the rotary drive shaft 100 is rotated, the crushing hammer 120 is erected outward in a radial direction by centrifugal force, and an object to be crushed is struck and crushed by a tip side front edge part of the crushing hammer 120.

PRIOR ART DOCUMENT

Patent Document

Patent Document 1: JP 8-117634 A

SUMMARY OF THE INVENTION

Problems to be Solved by the Invention

An erecting direction upper limit angle of the conventional crushing hammer 120 by the centrifugal force is not particularly regulated. Because of this, an erecting direction maximum angle of the crushing hammer 120 is, in general, approximately 90 degrees with respect to a tangent of the rotating disk 110. In this state, a distance from the rotary drive shaft 100 to a tip part of the crushing hammer 120 becomes maximum. When a radius of gyration of the tip part of the crushing hammer 120 becomes large, it is generally suitable for crushing an object to be crushed because of an increase in a circumferential speed of the tip part.

However, in a case of crushing a relatively hard object to be crushed, striking reaction force from the object to be crushed becomes large. Then, the crushing hammer 120 succumbs to the striking reaction force and is greatly brought down to a rear side in a rotating direction. As a result, there is a case where a sufficient crushing effect cannot be obtained.

Further, since amplitude of repeating rearward tilting operation of the crushing hammer 120 due to the striking reaction force and erection returning operation due to the centrifugal force is large, there has also been a problem in that relatively large noise and vibration are generated. Further, there has also been a problem in that a life of the crushing hammer 120 becomes relatively short due to the large striking reaction force and that the crushing hammer 120 must be replaced in a short period of time.

Further, since the rotary drive shaft 100 is started to rotate by a motor until an angle of the crushing hammer 120 reaches the maximum erecting angle, a load which is larger than that in steady operation is applied to the motor. Because of this, a motor having large starting torque must be selected when selecting the motor, thereby causing an increase in cost.

In a crusher having swinging type crushing hammers, an object of the present invention is to realize a crusher capable of suppressing starting torque of a motor serving as a driving means, improving a crushing capacity and crushing efficiency, and at the same time, suppressing noise and vibration.

Solutions to the Problems

A crusher of the present invention includes: a rotary drive shaft; a plurality of support shafts mounted in parallel with the rotary drive shaft on positions which are eccentric to the rotary shaft and are around the rotary drive shaft in a circumferential direction; and a plurality of crushing hammers swingably mounted to the support shafts. The plurality of crushing hammers are rotated about the rotary drive shaft so as to be erected outward in a radial direction by centrifugal force about the support shafts, respectively, to strike and crush an object to be crushed which is supplied from above the crushing hammers. An erecting angle regulating part is provided to regulate an erecting direction upper limit angle of each of the crushing hammers at a predetermined angle during driving of the rotary drive shaft.

Effects of the Invention

According to the crusher of the present invention, since the erecting angle regulating part is provided to regulate the erecting direction upper limit angle of the crushing hammer at the predetermined angle, the object to be crushed can be struck and crushed in a state that the crushing hammer is tilted.

Thus, crushing efficiency by the crushing hammer to the object to be crushed is improved, the striking reaction force received by the crushing hammer can be reduced, and the noise and vibration of the crusher can be reduced.

Further, since the erecting angle of the crushing hammer is regulated, starting torque of the rotary drive shaft can be reduced. With this configuration, miniaturization and cost reduction of the crusher can be attained by miniaturization and cost reduction of a motor for driving the rotary drive shaft.

EMBODIMENTS OF THE INVENTION

Hereinafter, an embodiment of a crusher according to the present invention will be described based on FIGS. 1 to 6.

(Entire Configuration of Crusher)

Figure 1:
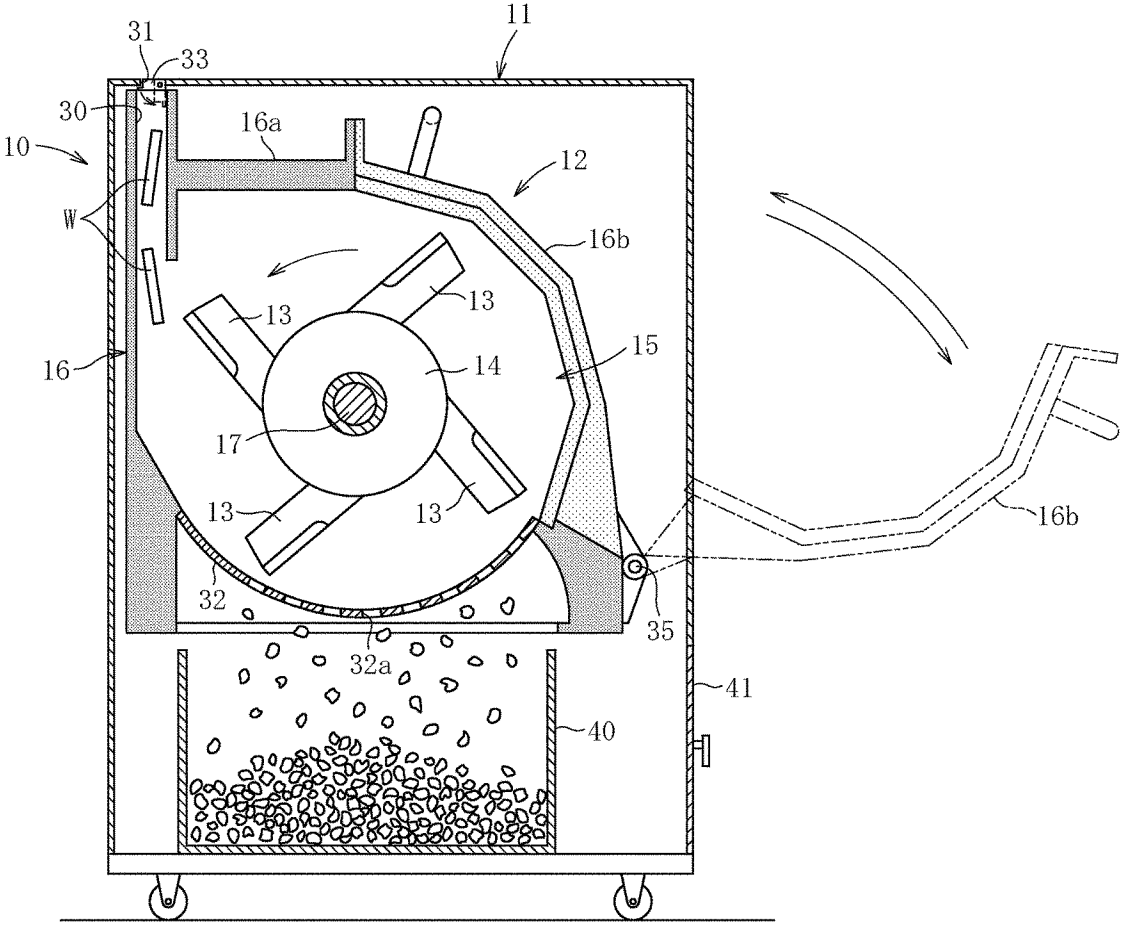
FIG. 1 is a schematic side view of a crusher body illustrating an embodiment of the present invention.
Figure 2:
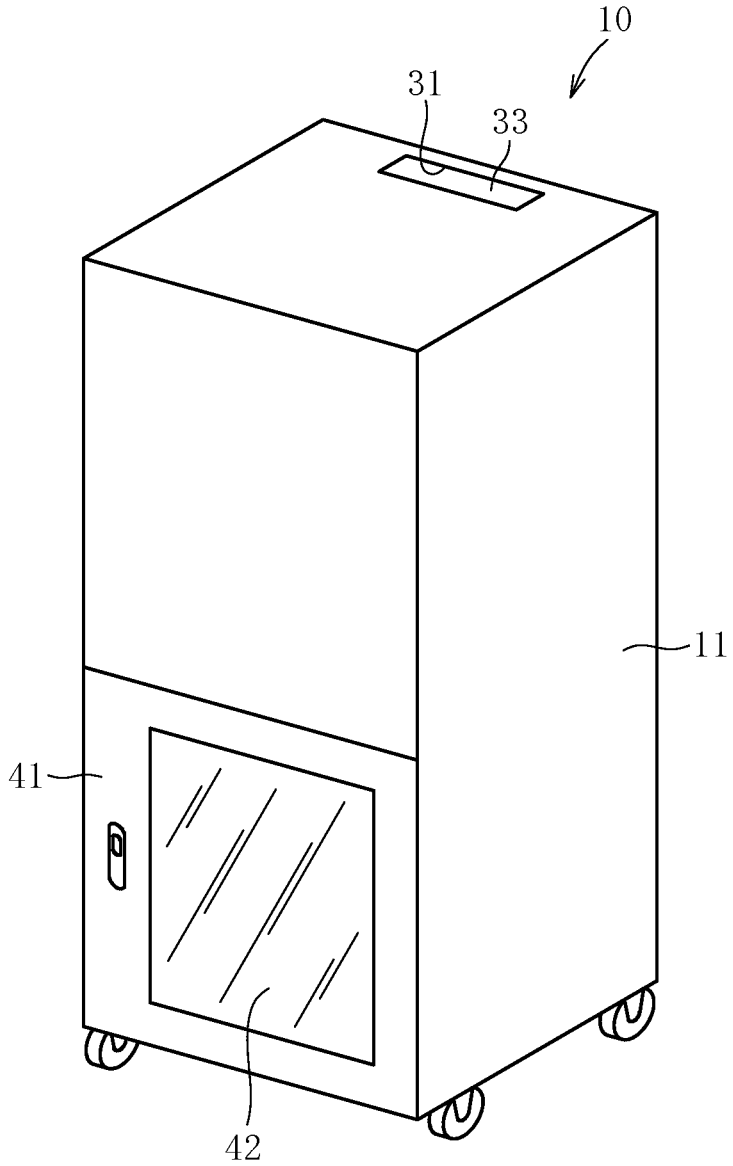
FIG. 2 is an exterior perspective view of the crusher.

As illustrated in FIGS. 1 and 2, a crusher 10 according to the embodiment of the present invention has an exterior case 11 and a crusher body 12 disposed within this exterior case 11. The crusher body 12 has a rotor 15 having a plurality of crushing hammers 13 and a rotating disk 14, and a casing 16 accommodating the rotor 15.

Figure 3:
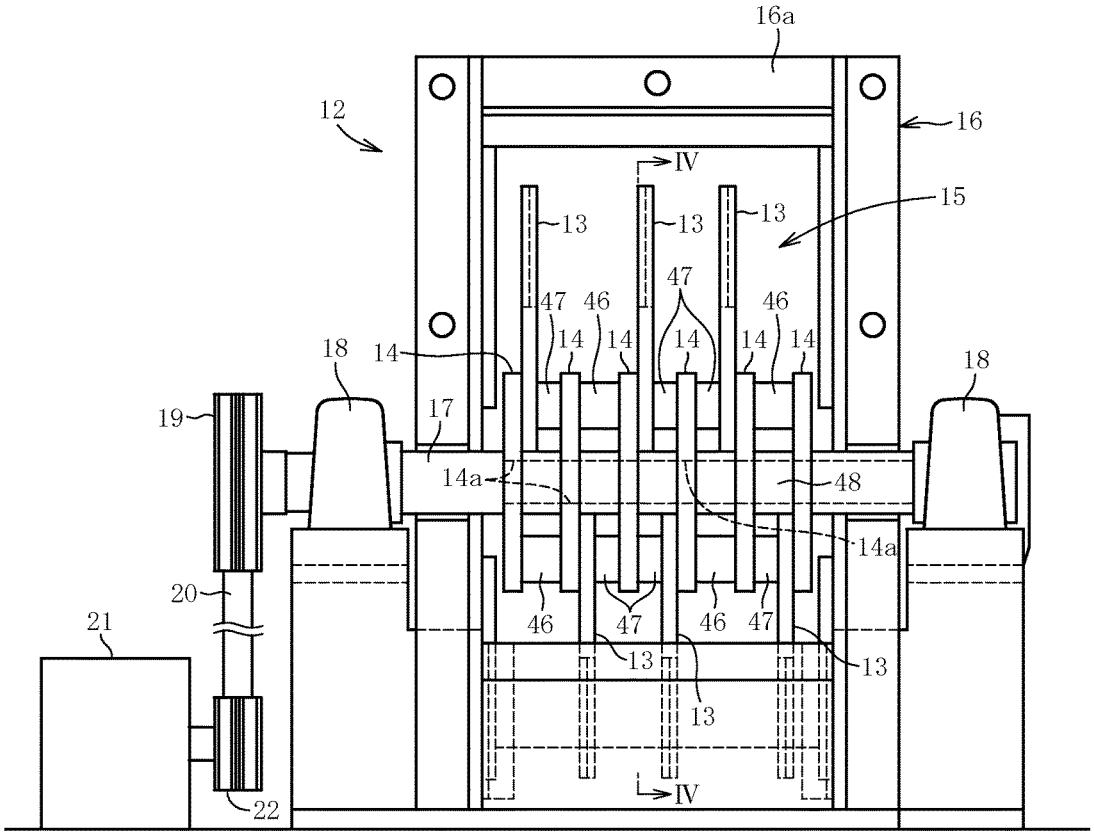
FIG. 3 is an internal front view of the crusher body in a state that a lid part is opened.

The rotor 15 is mounted to a horizontal rotary drive shaft 17 as in FIG. 3. Both ends of the rotary drive shaft 17 are supported by a pair of right and left bearings 18. A driven pulley 19 is fixed to one end of the rotary drive shaft 17 protruded to outside of the one bearing 18. This driven pulley 19 is coupled to a driving pulley 22 of a motor 21 via a transmission belt 20. The rotary drive shaft 17 and the rotor 15 are integrally rotated by driving the motor 21.

The casing 16 is provided between the right and left bearings 18. A periphery of the rotary drive shaft 17 and the rotor 15 is covered with this casing 16. As seen in FIG. 1, about two-thirds of a left side of the casing 16 is a body part 16*a* and a remaining one third is a lid part 16*b*. The rotary drive shaft 17 is disposed at a part divided into the body part 16*a* and the lid part 16*b*.

The lid part 16*b* can be opened to a front side with a support shaft 35 provided at a lower part thereof as a center. When an internal component, such as the rotor 15, is inspected, the lid part 16*b* is opened to the front side, as illustrated by chain lines in FIG. 1. The lid part 16*b* is normally closed as illustrated by solid lines in FIG. 1 and fixed to the body part 16*a* of the casing 16 by a plurality of bolts (not illustrated).

An input port 30 to which objects to be crushed W are inputted is formed at an upper part of the casing 16. The input port 30 is connected with an input port 31 provided on an upper surface of the exterior case 11. An internally opening type lid plate 33 is provided at the input port 31. The lid plate 33 is closed by a spring (not illustrated), as illustrated by solid lines in FIG. 1.

Further, a screen member 32 formed by bending a metal plate into an arc shape is provided at a lower part of the casing 16. This screen member 32 is a member for making sizes of the objects to be crushed uniform, and many circular holes 32*a* having a predetermined size are formed.

A crushed object accommodation box 40 for accommodating crushed objects dropped from the above-described screen member 32 is provided below the crusher body 12. This crushed object accommodation box 40 can be taken out to outside by opening a front door 41.

It is desirable that the crushed object accommodation box 40 be formed of a transparent plastic or the like and a container whose inside is visible. Further, an inspection window 42, to which a transparent plate is fitted, is provided at the front door 41. Therefore, in a state that the front door 41 is closed, a condition of the crushed objects inside the crushed object accommodation box 40 can be checked through the inspection window 42.

(Rotor of Crusher)

Next, a structure of the rotor 15 will be described. As illustrated in FIG. 3, the six rotating disks 14 are fixed to the rotary drive shaft 17 at an equal interval. A key and a key groove, welding, and the like can be used as a fixing method. As described below, a mutual distance between the rotating disks 14 is regulated by three kinds of collars 46 to 48 and the crushing hammers 13.

Figure 4:
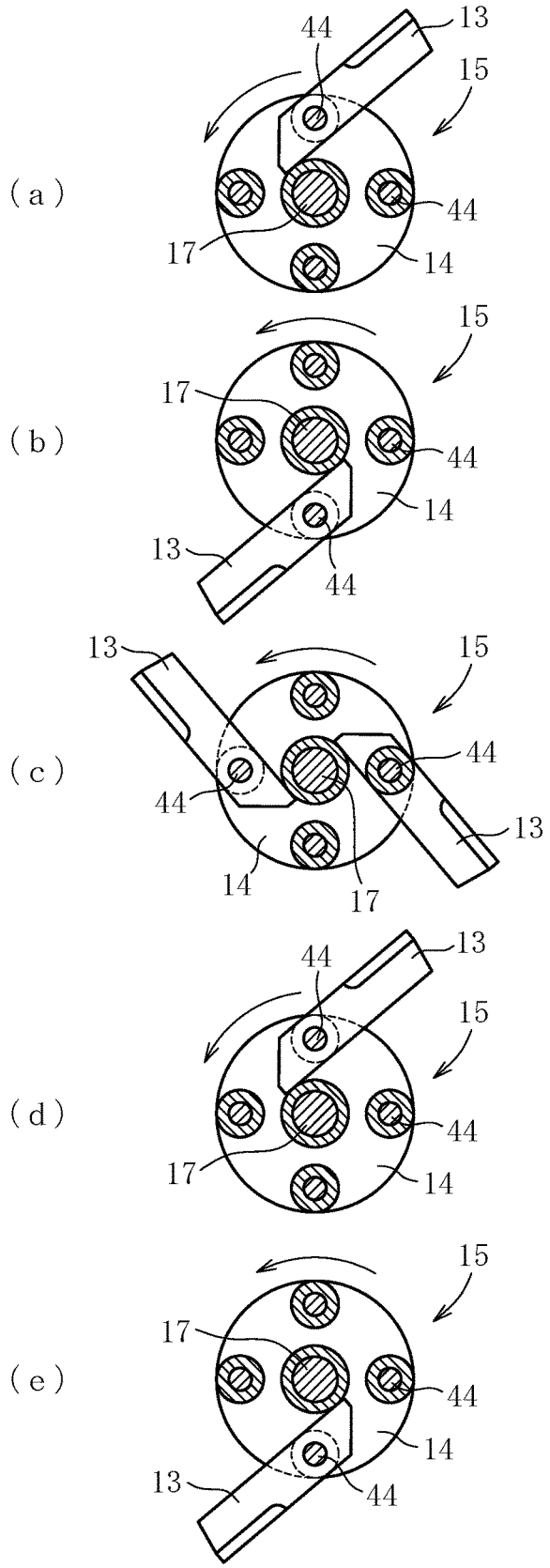
FIGS. 4(*a*) to 4(*e*) are diagrams illustrating rotating disks and crushing hammers of a rotor of the crusher body.

The rotating disks 14 illustrated in FIGS. 4(*a*) to 4(*e*) sequentially illustrate the rotating disk 14 which is the second from a left end of the rotary drive shaft 17 in FIG. 3, to the rotating disk 14 at a right end thereof. As illustrated, each rotating disk 14 has a shaft hole 14*a* at its center. The rotary drive shaft 17 is fitted into the shaft holes 14*a* so as to penetrate the six rotating drive disks 14.

A collar 48 for protecting the rotary drive shaft 17 is installed in an outer circumference of the rotary drive shaft 17. The mutual distance between the rotating disks 14 is regulated by this collar 48.

In the embodiment of the present invention, as illustrated in FIG. 3, respective five columns of spaces for providing the crushing hammers 13 are formed among the six rotating disks 14. Within the five columns of spaces, base end parts of the crushing hammers 13 are swingably supported by support shafts 44. It should be noted the crushing hammers 13 in a center in FIG. 3 (on a right side of a line IV-IV representing a cross section) are illustrated in a vertical state for convenience so that the crushing hammers 13 can be seen from a front.

FIG. 4(*c*) illustrates the crushing hammer 13 provided in a central space (third column space) of the above-described five columns of spaces. In FIG. 4(*c*), two crushing hammers 13 are symmetrically mounted to the rotating disk 14 with a phase difference of 180° in the circumferential direction.

In contrast, in FIG. 4(*b*) (second column space), one crushing hammer 13 is mounted to the rotating disk 14 with the support shaft 44 so as to form a phase difference of 90° in the circumferential direction with respect to the two crushing hammers 13 in FIG. 4(*c*).

In FIG. 4(*a*) (first column space), one crushing hammer 13 is mounted to the rotating disk 14 with the support shaft 44 so as to form a phase difference of 180° in the circumferential direction with respect to the crushing hammer 13 in FIG. 4(*b*).

On the other hand, in the central space of FIG. 4(*d*) (fourth column space) as well, one crushing hammer 13 is mounted to the rotating disk 14 with the support shaft 44 so as to form a phase difference of 90° in the circumferential direction with respect to the two crushing hammers 13 in FIG. 4(*c*).

In FIG. 4(*e*) (fifth column space), one crushing hammer 13 is mounted to the rotating disk 14 with the support shaft 44 so as to form a phase difference of 180° in the circumferential direction with respect to the crushing hammer 13 in FIG. 4(*d*).

In this way, a total of six crushing hammers 13 are mounted to the rotary drive shaft 17 from the first column space to the fifth column space, the respective crushing hammers 13 are distributedly disposed uniformly in an axial direction and a circumferential direction of the rotary drive shaft 17. Further, the respective right and left three crushing hammers 13 are disposed symmetrically with respect to a central part of the right and left pair of bearings 18, that is, with respect to a longitudinal direction center of the rotary drive shaft 17.

Therefore, a space sufficient to receive the objects to be crushed is secured between the plurality of crushing hammers 13, and a rotational balance between the crushing hammers 13 and the rotating disks 14 is maintained. With this configuration, an efficient crushing process of the objects to be crushed can be attained.

Four shaft holes 14*b* are formed at a circumferential edge part of the rotating disk 14 at an equal interval (interval of) 90° in the circumferential direction. The support shafts 44 for supporting the rotary drive shaft 17 and the crushing hammers 13 are penetrated through these shaft holes 14*b*.

The support shafts 44 extend parallel to the rotary drive shaft 17 and penetrate the six rotating disks 14 in the same way as the rotary drive shaft 17. Both end parts of the support shaft 44 protrude by a short distance to outside from outer surfaces of the right and left pair of the rotating disks 14 disposed on both end sides of the rotary drive shaft 17.

The two kinds of collars 46, 47 having different widths (axis direction lengths) are installed in an outer circumference of the support shaft 44 between the rotating disks 14. The one having a large width is the first collar 46, and the one having a small width is the second collar 47. The first collar 46 having a large width is installed in the support shaft 44, to which the crushing hammer 13 is not mounted.

The first collar 46 regulates the mutual distance between the rotating disks 14 and also functions as a hammer receiver receiving the crushing hammer 13. In other words, when the crushing hammer 13 strikes the object to be crushed, the crushing hammer 13 is swung in a direction opposite to the rotating direction by its reaction force. When the crushing hammer 13 swings in the direction opposite to the rotating direction, a tip side rear edge part of the crushing hammer 13 abuts on the first collar 46 serving as the hammer receiver. With this configuration, a swinging position of the crushing hammer 13 in the direction opposite to the erecting direction is regulated.

Since the crushing hammer 13 repeatedly collides with the first collar 46, wear of the first collar 46 proceeds corresponding to operating time of the crusher 10. Therefore, the first collar 46 is an expendable component which must be replaced depending on a predetermined operating time of the crusher 10.

On the other hand, the second collar 47 having a small width is installed in the outer circumference of the support shaft 44, to which the crushing hammer 13 is mounted. The second collar 47 regulates the mutual distance between the rotating disks 14 together with the crushing hammer 13.

(C-Ring)

Figure 5:
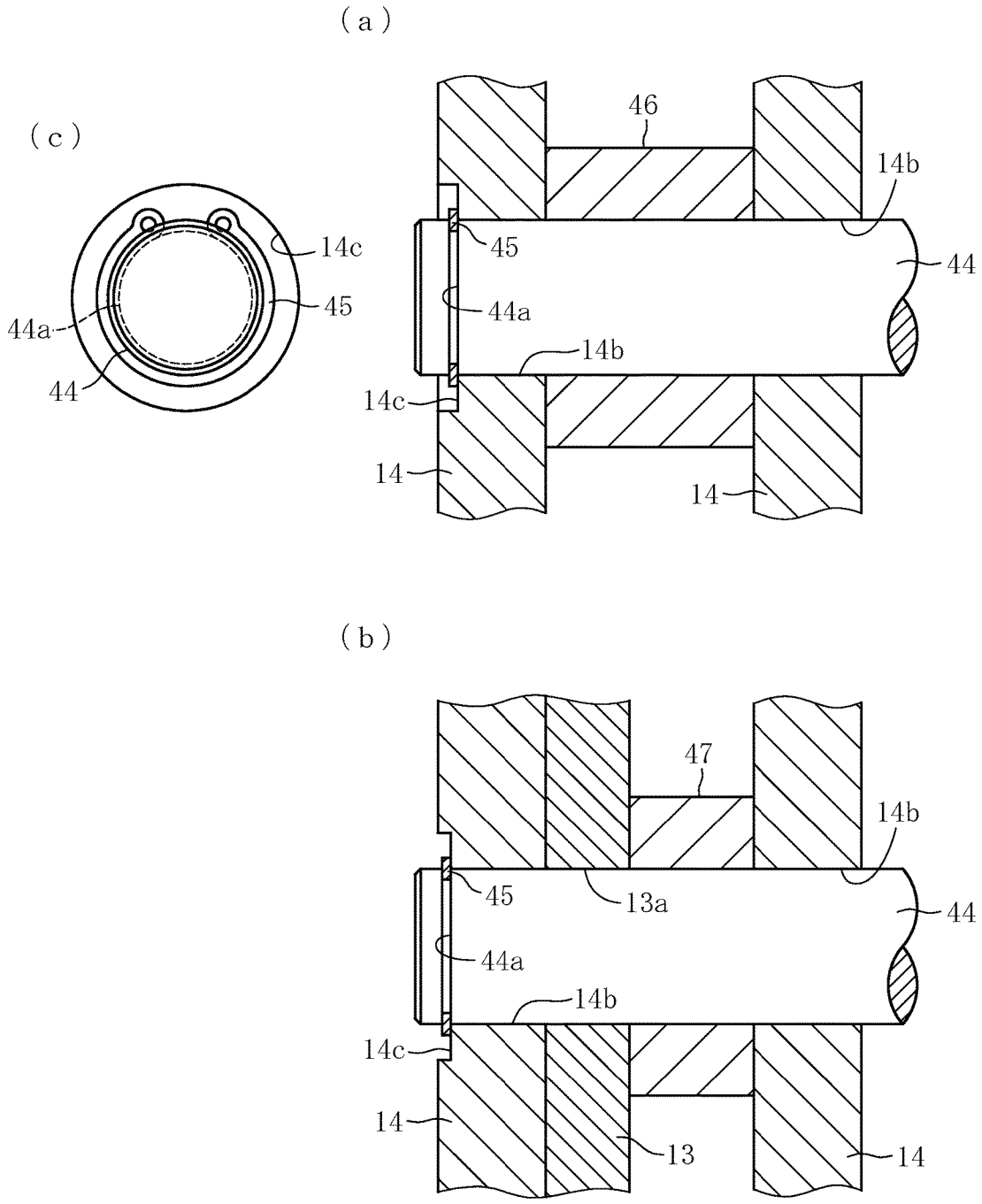
FIGS. 5(*a*) to 5(*c*) are diagrams illustrating an end part of a support shaft of the crushing hammer.

As illustrated in FIGS. 5(*a*) to 5(*c*), an annular groove 44*a* is formed at both end parts of the support shaft 44 protruded to outside from the rotating disks 14 at both ends. A C-ring 45 for preventing the support shaft 44 from coming off is fitted into the annular groove 44*a*.

A circular recessed part 14*c* for accommodating the C-ring 45 is formed on the outer surfaces of the rotating disks 14 at both ends. This recessed part 14*c* is a part for protecting the C-ring 45, and direct collision of the crushed object against the C-ring 45 is prevented by the recessed part 14*c*.

The support shaft 44 can be easily pulled out from the rotating disks 14 in the axial direction by removing at least one of the C-rings 45. When the support shaft 44 is pulled out, the crushing hammer 13 and the collars 46, 47 can be removed. Thus, the crushing hammer 13 can be replaced with a different kind of hammer, or the crushing hammer 13 and the collars 46, 47, which have reached the end of life, can be replaced with a new crushing hammer 13 and new collars 46, 47.

(Crushing Hammer)

Figure 6:
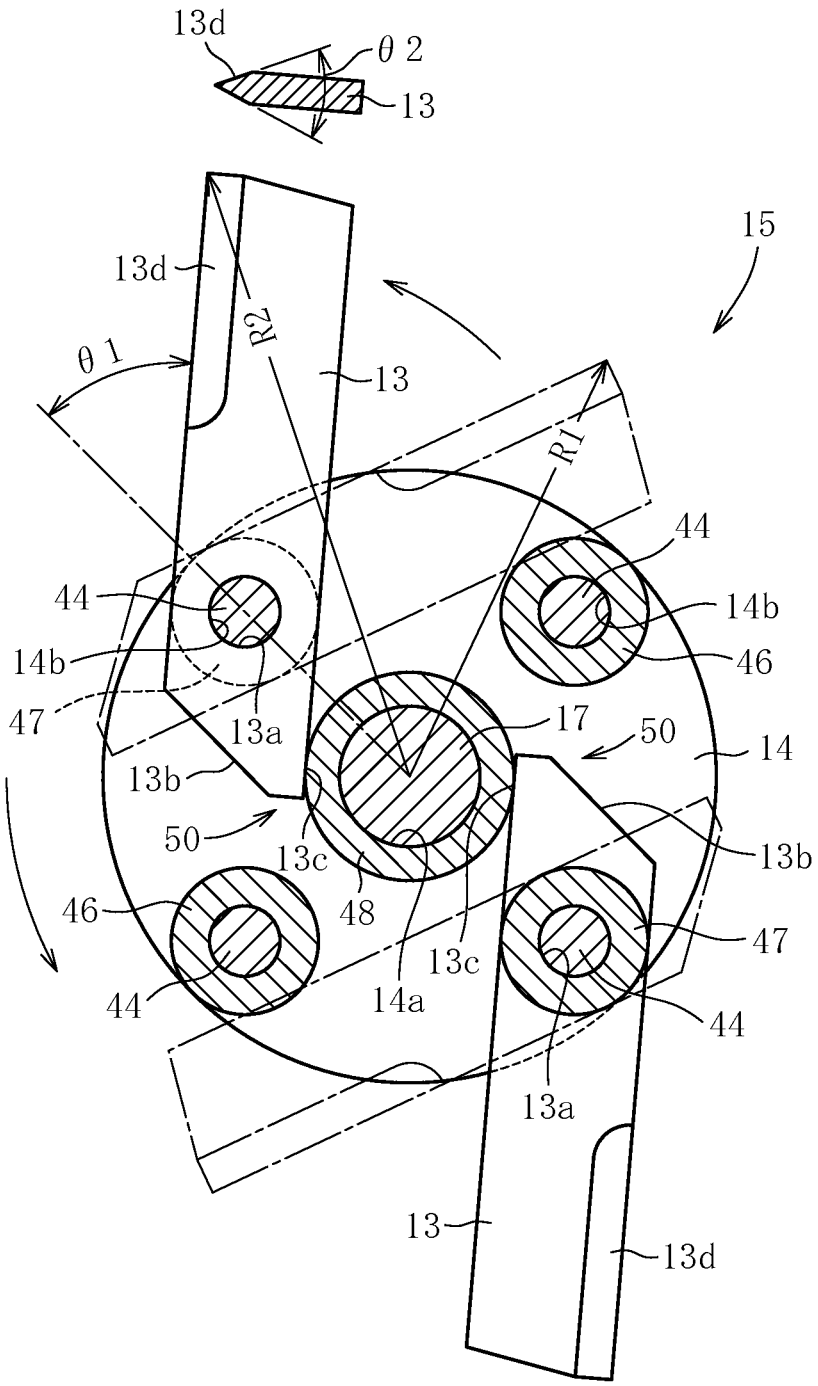
FIG. 6 is a cross-sectional view as viewed from a line IV-IV in FIG. 3.
Figure 7:
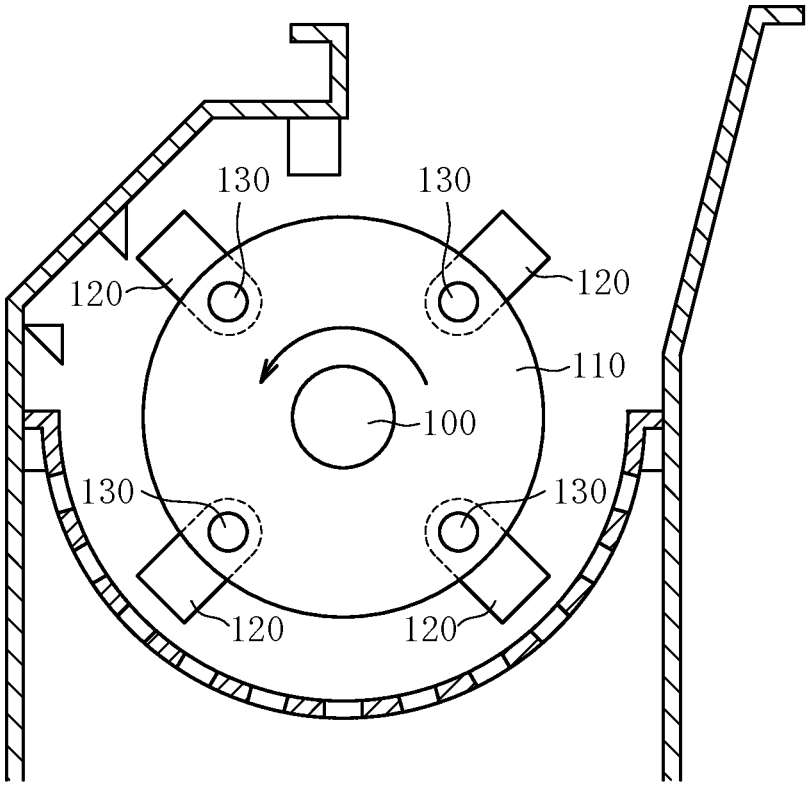
FIGS. 7(*a*) and 7(*b*) are cross-sectional views of a conventional crusher.
Figure 7:
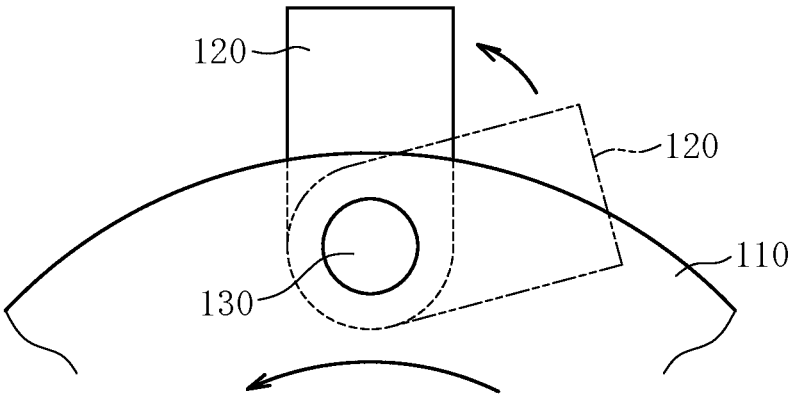

FIG. 6 is a cross-sectional view as viewed from a line IV-IV in FIG. 3 and illustrates the rotating disk 14 at the center and the two crushing hammers 13. The crushing hammer 13 is formed in a shape of an elongated strip and can be manufactured by processing, for example, rectangular flat steel plate.

A hole part 13*a*, through which the support shaft 44 is inserted, is formed at one end part of the crushing hammer 13. The end part of the crushing hammer 13, on which this hole part 13*a* is disposed, is diagonally cut so as to form a tilted part 13*b*.

The tilted part 13*b* is provided to prevent abase end side angular part of the crushing hammer 13 from greatly jumping out outward in a radial direction from an outer circumference of the rotating disk 14 when the crushing hammer 13 collides with the object to be crushed during rotation and is brought down to a rear side in the rotating direction as illustrated by chain lines. When the base end side angular part jumps out to outside, there is a possibility that the object to be crushed collides with this part, the crushing hammer 13 is damaged, and a crack is generated around the hole part 13*a*. It should be noted that, instead of the tilted part 13*b*, the part may be an arc part conforming the outer circumference of the rotating disk 14.

An abutment part 13*c* is formed adjacent to a terminal side of the tilted part 13*b* of the crushing hammer 13. This abutment part 13*c* is disposed on a linear rear edge of the crushing hammer 13. When the crushing hammer 13 is erected by centrifugal force as illustrated by solid lines in FIG. 6, the crushing hammer 13 abuts on the third collar 48 fitted to the outer circumference of the rotary drive shaft 17.

An erecting angle regulating part 50 is formed of the abutment part 13*c* of the crushing hammer 13 and the third collar 48. In this embodiment, an erecting angle of the crushing hammer 13 is set to approximately 50°.

In other words, an angle θ1 formed by a tip side front edge part (blade part 13*d*) of the crushing hammer 13 and a straight line connecting the rotary drive shaft 17 and the support shaft 44 is set to approximately 50°. Needless to say, the angle θ1 can be appropriately changed depending on the type of the object to be crushed or the like.

In other words, the angle θ1 can be set to, for example, a predetermined angle between 10° and 80°. Further, the angle θ1 can be desirably set to the predetermined angle between 20° and 70°, more desirably between 30° and 60°, and further more desirably between 35° and 55°.

In the crusher 10 of the present embodiment, when the above-described angle θ1 is 10° or less, a noise and vibration reduction effect of the crusher 10 can be hardly obtained and a starting torque reduction effect of the rotary drive shaft 17 can be hardly obtained as well. Further, when the angle θ1 is 80° or more, a crushing reduction effect of the objects to be crushed can be hardly obtained.

The blade part 13*d* having a sharpened edge part and a predetermined length is formed at the front edge part of the crushing hammer 13 on a side opposite to the hole part 13*a*, i.e., the tip side front edge part of the crushing hammer 13. This blade part 13*d* is formed at an acute angle having a V-shaped cross section for improving crushing capacity or crushing efficiency, and an angle θ2 of the blade part 13*d* is approximately 50° in the present embodiment. Needless to say, the angle θ2 can be changed depending on the type of the object to be crushed or the like.

In the embodiment of the present invention, each crushing hammer 13 is rotated in a tilted state (θ1=50° in the illustrated example) as in FIGS. 4(*a*) to 4(*e*) and FIG. 6. With this configuration, since a substantial blade angle of θ2 of the blade part 13*d* becomes smaller than θ2, the crushing capacity of the crushing hammer 13 is improved. Further, a load or striking reaction force against the blade part 13*d* can be reduced. Therefore, improvement of the crushing capacity and improvement of a life of the crushing hammer 13 can be attained.

Because of this, since the crushing efficiency of the object to be crushed by the blade part 13*d* is improved and the striking reaction force received by the crushing hammer 13 is reduced, the noise and vibration of the crusher 10 can be reduced.

Further, since the erecting angle of the crushing hammer 13 is regulated by the aforementioned erecting angle regulating part 50, the starting torque of the rotary drive shaft 17 can be reduced. With this configuration, miniaturization and cost reduction of the crusher 10 can be achieved by miniaturization and cost reduction of the motor used for driving the rotary drive shaft 17.

The blade part 13*d* of the above-described crushing hammer 13 is formed linearly in the illustrated example. However, it is not always necessary that the blade part 13*d* is formed linearly. The blade part 13*d* may also be formed in an arched shape. In other words, the blade part 13*d* may also be formed in an arc shape so as to protrude forward. With such an arched shape, a so-called "pulling and cutting" effect of the blade part 13*d* can be enhanced, the crushing efficiency is further improved, and at the same time, the life of the crushing hammer 13 can be improved.

(Crushing Action of Crushing Hammer)

The crusher 10 according to the embodiment of the present invention is structured as described above. When the rotary drive shaft 17 is rotated by the motor 21 so as to rotate the crushing hammers 13, the objects to be crushed supplied from above the crushing hammers 13 are crushed by the crushing hammers 13. The crushed objects are dropped downward from the circular holes 32*a* of the screen member 32 and accommodated within the crushed object accommodation box 40.

When the crushing hammer 13 is rotated, first, as illustrated by the chain lines in FIG. 6, the crushing hammer 13 is started to rotate in a state of abutting on the collar 46 on the rear side in the rotating direction. As the number of rotations of the rotary drive shaft 17 increases, the crushing hammer 13 is erected in an arrow direction by centrifugal force, as illustrated by the illustrated solid lines. Then, finally, the abutment part 13*c* on the base end side, through which the support shaft 44 is penetrated, abuts on the collar 48 of the rotary drive shaft 17, and the tilted angle θ1 is made constant. In this state, the crushing hammer 13 is integrally rotated with the rotary drive shaft 17 so as to crush the object to be crushed.

In this embodiment, the tilted angle θ1 is approximately 50°. Needless to say, the tilted angle is not limited to approximately 50° and can be changed depending on the type of the object to be crushed, the type of the crushing hammer 13 to be used, the number of rotations of the rotary drive shaft 17, or the like.

The crushing hammer 13 does not always maintain the above-described tilted angle θ1 during the rotation. When abutting on the object to be crushed, the crushing hammer 13 itself swings in a clockwise direction (rearward) as illustrated due to the reaction force in a collision with the object to be crushed while crushing the object to be crushed. Due to this rearward swing, the crushing hammer 13 collides with the collar 46 on the rear side in the rotating direction. However, the crushing hammer 13 is swung again so as to rebound in the arrow direction due to the action of this collision reaction force and the centrifugal force, and returns to the erecting state at the above-described tilted angle θ1 in a short time.

While repeating such a swing at high speed, the crushing hammer 13 successively crushes the objects to be crushed. In a case of a small object to be crushed or a relatively soft object to be crushed, the crushing hammer 13 does not necessarily swing to the collar 46 on the rear side. Before abutting the collar 46, the crushing hammer 13 is rotated in the arrow direction (counterclockwise direction) by the action of centrifugal force and returns to the original tilted angle θ1.

As illustrated by the chain lines in FIG. 6, the crushing hammer 13 is laid sideways at the initial starting. Therefore, a radius of gyration R1 of the tip part of the crushing hammer 13 is relatively small. Because of this, the starting torque necessary for the motor 21 can be suppressed, and even the motor 21 with a small rating can be practically used without hindrance. With this configuration, cost reduction and power reduction of the crusher 10 can be attained.

As illustrated, the radius of gyration of the tip part of the crushing hammer 13 is increased to R2 during the rotation. With this configuration, the object to be crushed can be strongly crushed due to the increase in circumferential speed. Moreover, since the crushing hammer 13 is tilted rearward in the rotating direction at the angle θ1, the angle θ2 of the blade part 13*d* is more sharpened than the actual angle, and even a hard object to be crushed can be easily crushed by small impulsive force. Therefore, the reaction force acted on the crushing hammer 13 at the time of crushing can be reduced, an increase in the life of the crushing hammer 13, an increase in the life of the collar 46, and a decrease in the vibration and noise of the crusher 10 can be attained.

The embodiment of the present invention has been described above. However, the present invention is not limited to the above-described embodiment and various variations are possible. For example, it is not necessary that the number of rotating disks 14 is always six. The number of rotating disks 14 may be six or more or four or less as long as it is two or more. In short, the crushing hammers 13 can be provided in arbitrary number of multiple columns.

Further, it is not necessary that the support shaft 44 of the crushing hammer 13 is always supported by the rotating disk 14. A suitable supporting member which can be replaced with the rotating disk 14 maybe used. In short, the supporting member may have any structure as long as the erecting angle regulating part 50 which regulates the erecting direction upper limit angle of the crushing hammer at the predetermined angle can be provided such that the swinging type crushing hammer 13 can be rotated with being tilted rearward in the rotating direction at the predetermined angle.

DESCRIPTION OF REFERENCE SIGNS

10: crusher
11: exterior case
12: crusher body
13: crushing hammer
13*a*: hole part
13*b*: tilted part
13*c*: abutment part
13*d*: blade part
14: rotating disk
14*a*: shaft hole
14*b*: shaft hole
14*c*: recessed part
15: rotor
16: casing
16*a*: body part
16*b*: lid part
17: rotary drive shaft
18: bearing
19: driven pulley
20: transmission belt
21: motor
22: driving pulley
30: input port
31: input port

32: screen member
32*a*: circular hole
33: lid plate
35: support shaft
40: crushed object accommodation box
41: front door
42: inspection window
44: support shaft
44*a*: annular groove
45: c-ring
46: first collar
47: second collar
48: third collar
50: erecting angle regulating part
100: rotary drive shaft
110: rotating disk
120: crushing hammer
130: support shaft
r1: radius of gyration
r2: radius of gyration

The invention claimed is:

1. A crusher comprising:

a rotary drive shaft;

a plurality of support shafts mounted in parallel with the rotary drive shaft at positions which are eccentric to the rotary drive shaft and are around the rotary drive shaft in a circumferential direction; and a plurality of crushing hammers swingably mounted to the support shafts, the plurality of crushing hammers being rotated about the rotary drive shaft so as to be erected outward in a radial direction by centrifugal force about the support shafts, respectively, to strike and crush an object to be crushed which is supplied from above the crushing hammers, wherein an erecting angle regulating part is provided to regulate an erecting direction upper limit angle of each of the crushing hammers at a predetermined angle during driving of the rotary drive shaft; and the erecting angle regulation part is formed of a part of each of the crushing hammers on a base end side and an outer circumferential surface of the rotary drive shaft on which the part of the crushing hammer on the base end side abuts.

2. The crusher according to claim 1, wherein in a state where one of the crushing hammers is erected at the erecting direction upper limit angle, a tip side front edge part serving as a striking part of the crushing hammer is tilted rearward in a rotating direction of the rotary drive shaft at a predetermined angle.

3. The crusher according to claim 2, wherein the tip side front edge part of the crushing hammer is tilted rearward in the rotating direction of the rotary drive shaft at a predetermined angle between 10° and 80°.

4. A crusher comprising:

a rotary drive shaft a plurality of support shafts mounted in parallel with the rotary drive shaft at positions which are eccentric to the rotary drive shaft and are around the rotary drive shaft in a circumferential direction;

a plurality of crushing hammers swingably mounted to the support shafts, the plurality of crushing hammers being rotated about the rotary drive shaft so as to be erected outward in a radial direction by centrifugal force about the support shafts, respectively, to strike and crush an object to be crushed which is supplied from above the crushing hammers;

a plurality of rotating disks fixed to the rotary drive shaft at a predetermined interval, at least one of the crushing hammers being mounted between circumferential edge parts of a pair of the rotating disks with one of the support shafts; and at least one hammer receiver mounted between the circumferential edge parts of the pair of the rotating disks separated from the one of the support shafts in the circumferential direction, wherein an erecting angle regulating part is provided to regulate an erecting direction upper limit angle of each of the crushing hammers at a predetermined angle during driving of the rotary drive shaft, a swinging position of the at least one of the crushing hammers in a direction opposite to an erecting direction is regulated by abutting a tip side rear edge part of the at least one of the crushing hammers on the hammer receiver, and a collar on which the tip side rear edge part of the at least one of the crushing hammers is abuttable is replacably installed at an outer circumference of the hammer receiver.

5. The crusher according to claim 4, wherein the collar functions as a spacer regulating a mutual distance between the pair of the rotating disks.

6. The crusher according to claim 4, wherein at least one end part of the one of the support shafts protrudes from an outer surface of one of the rotating disks fixed to end sides of the rotary drive shaft, and a C-ring for preventing the one of the support shafts from coming off is installed at the at least one end part.

7. The crusher according to claim 6, wherein a recessed part capable of accommodating the C-ring is formed on the outer surface of the one of the rotating disks.

8. The crusher according to claim 4, wherein the plurality of rotating disks is three or more rotating disks mounted to the rotary drive shaft, the crushing hammers are mounted in an axis direction of the rotary drive shaft in a plurality of columns, and a mounting position of one of the crushing hammers of one of the plurality of columns of the crushing hammers in the circumferential direction is different from a mounting position of an adjacent one of the crushing hammers.

9. The crusher according to claim 8, wherein the mounting positions of the crushing hammers are symmetric with respect to a longitudinal direction central part of the rotary drive shaft.

* * * * *